US009416643B2

(12) United States Patent
Purkis et al.

(10) Patent No.: US 9,416,643 B2
(45) Date of Patent: Aug. 16, 2016

(54) SELECTIVE FRACTURING SYSTEM

(71) Applicant: Petrowell Limited, Dyce, Aberdeen, Aberdeenshire (GB)

(72) Inventors: Daniel George Purkis, Aberdeen (GB); Richard Atkinson, Aberdeen (GB)

(73) Assignee: Petrowell Limited, Aberdeen (GB)

( * ) Notice: Subject to any disclaimer, the term of this patent is extended or adjusted under 35 U.S.C. 154(b) by 314 days.

(21) Appl. No.: 13/789,912

(22) Filed: Mar. 8, 2013

(65) Prior Publication Data

US 2014/0102708 A1 Apr. 17, 2014

(30) Foreign Application Priority Data

Mar. 8, 2012 (GB) ..... 1204100.0

(51) Int. Cl.
*E21B 43/26* (2006.01)

(52) U.S. Cl.
CPC ..... *E21B 43/26* (2013.01)

(58) Field of Classification Search
CPC ..... E21B 43/26; E21B 43/268
See application file for complete search history.

(56) References Cited

U.S. PATENT DOCUMENTS

| | | | |
|---|---|---|---|
| 2001/0050172 A1 | 12/2001 | Tolman et al. | |
| 2005/0061508 A1 | 3/2005 | Surjaatmadja | |
| 2006/0000620 A1 | 1/2006 | Hamilton | |
| 2006/0124311 A1 | 6/2006 | Lopez de Cardenas et al. | |
| 2007/0151734 A1 | 7/2007 | Fehr et al. | |
| 2009/0159299 A1 | 6/2009 | Kratochvil et al. | |
| 2009/0260814 A1* | 10/2009 | Malone | 166/276 |
| 2010/0044041 A1 | 2/2010 | Smith et al. | |
| 2010/0108323 A1 | 5/2010 | Wilkin | |
| 2010/0282469 A1 | 11/2010 | Richard et al. | |
| 2011/0240301 A1 | 10/2011 | Robison et al. | |

(Continued)

FOREIGN PATENT DOCUMENTS

GB 2434820 B 11/2009

OTHER PUBLICATIONS

Petrowell, "RFID Products" [online], published Aug. 13, 2009. Available from http://www.petrowell.co.uk/index.php?option=com_docman&task=cat_view&gid=107&Itemid=26 [accessed Nov. 6, 2012]. See especially RFID Operated Frac Sleeve and RFID Operated Fall Through Flapper.

(Continued)

*Primary Examiner* — William P Neuder
(74) *Attorney, Agent, or Firm* — Blank Rome LLP

(57) ABSTRACT

A method of fracturing a formation surrounding a wellbore comprises the steps of:

(i) providing a tubular including at least two portions, each portion comprising an annulus isolation means, a selective flow path between the interior and the exterior of the tubular and a throughbore isolation means;
(ii) running the tubular into the wellbore;
(iii) isolating an annulus between the exterior of the tubular and the wellbore to thereby create at least two isolated zones;
(iv) selecting any zone to be fractured;
(v) remotely opening the flow path in the portion of tubular corresponding to the selected zone;
(vi) remotely isolating the throughbore of the tubular by closing the throughbore isolation means in the portion of tubular corresponding to the selected zone; and
(vii) fracturing at least part of the formation surrounding the well.

19 Claims, 6 Drawing Sheets

(56) References Cited

U.S. PATENT DOCUMENTS

| | | | | |
|---|---|---|---|---|
| 2011/0284214 | A1 | 11/2011 | Ayoub et al. | |
| 2013/0014953 | A1 * | 1/2013 | van Petegem | 166/308.2 |

OTHER PUBLICATIONS

Petrowell, "A system's approach to addressing injector and producer well challenges" [online]. Google cache May 28, 2012. Available from http://www.petrowell.co.uk/doingmorewithless/.

Petrowell, What are Presto's main components? [online], Created Feb. 12, 2009, Modified Mar. 18, 2010. Available from http://www.petrowell.co.uk/doingmorewithless/images/main_components.pdf.

Search Report received in corresponding UK patent application No. GB1204100.0 dated Jun. 12, 2012.

Extended Search Report issued in corresponding European Application No. EP13157900 dated Jul. 24, 2014.

Patent Examination Report No. 1 received in corresponding Australian Application No. 2013201372 dated Aug. 21, 2014.

Patent Examination Report No. 2 received in corresponding Australian Application No. 2013201372 dated Oct. 13, 2015.

* cited by examiner

SELECTIVE FRACTURING SYSTEM

CROSS-REFERENCE TO RELATED APPLICATIONS

This application claims priority to United Kingdom Patent Application No. GB1204100.0 filed on Mar. 8, 2012, the contents of which are incorporated herein by reference.

FIELD OF THE INVENTION

The present invention relates to a method of fracturing (fracing) a formation surrounding a wellbore.

BACKGROUND OF THE INVENTION

Typical fracturing systems move a fracture sleeve to uncover ports in a completion string. In a conventional fracture system, this is achieved by landing a dropped ball on a ball seat attached to the sleeve. Once a sufficient pressure differential is achieved across the ball, the seat and the attached fracturing sleeve are moved axially to uncover the ports. Fracturing fluid ibs pumped downhole and out into the surrounding formation through the ports. In order to fracture a multi-zone well, the ball seats decrease in diameter from the heel to the toe of the well. The smallest ball is dropped first and passes through all the larger ball seats until it lands on the seat closest to the toe of the well. Once the first zone has been successfully fractured, successively larger balls can then be dropped to initiate fracture port opening for each subsequent fracture zone.

The ever decreasing ball seats have several known disadvantages. The restrictions in inner diameter through the ball seats have a negative impact on the effectiveness of the fracture closest to the toe of the well. This disadvantage can be overcome by the use of powerful pumps to transmit fracturing fluid through the narrow bore, although this is costly.

Additionally, once fracturing operations are complete, the balls must be removed from the system before production can begin. Existing methods for removing the balls involve drilling out the balls and seats, flowing the balls back to surface and/or using dissolvable balls. Each of these methods is time consuming and pose a risk and/or limitation to production of hydrocarbons.

The present invention aims to alleviate at least some of the aforementioned disadvantages.

It is an object of at least one aspect of at least one embodiment of the present invention to seek to obviate or at least mitigate one or more problems and/or disadvantages in the prior art.

According to a first aspect of the present invention there is provided a method of fracturing a formation surrounding a well bore comprising the steps of:

(i) providing a tubular including at least two portions, each portion comprising an annulus isolation means, a selective flow path between the interior and the exterior of the tubular and a throughbore isolation means;

(ii) running the tubular into the wellbore;

(iii) isolating an annulus between the exterior of the tubular and the wellbore to thereby create at least two isolated zones;

(iv) electing any zone to be fractured;

(v) remotely opening the flow path in the portion of tubular corresponding to the selected zone;

(vi) remotely isolating the throughbore of the tubular by closing the throughbore isolation means in the portion of tubular corresponding to the selected zone; and (vii) fracturing at least part of the formation surrounding the well. The method can also include the steps of:

(viii) remotely closing the flow path in the portion of tubular corresponding to the selected zone; and (ix) opening the throughbore of the tubular by remotely opening the throughbore isolation means in the portion of tubular corresponding to the selected zone.

At least steps (iv)-(vi) can be repeated to thereby fracture at least part of the formation surrounding a different zone of the well.

Step (iv) can include the step of selecting an uphole zone to be fractured before a downhole zone to be fractured.

In this context, "uphole" can be construed as meaning closer to either a heel of the wellbore or the surface and "downhole" can be taken to mean closest to a toe of the well distal from the surface.

The throughbore is preferably isolated downhole of the flow path. Preferably the throughbore isolation means in each portion of tubular is located immediately downhole of the selective flow path. The throughbore isolation means is preferably positioned proximate the selective flow path in each portion of the tubular.

The method can further include the steps of:

providing a tubular including a plurality of portions;

creating a plurality of zones;

selecting one zone at a time in any order; and successively fracturing at least a portion of the formation surrounding each selected zone.

The method can include:

providing a tubular including a plurality of portions;

creating a plurality of zones;

selecting one zone at a time in a sequential manner; and sequentially fracturing at least a part of the formation surrounding each selected zone.

The method can include:

selecting one zone at a time in a sequential manner from a heel of the well towards a toe of the well, and sequentially fracturing at least a part of the formation surrounding each selected zone.

In a deviated well, the heel of the well typically refers to the part of the well closest to the point of deviation. The toe of the well typically refers to the part of the well distal from the deviated portion.

Alternatively, the method can include:

selecting one zone at a time in a sequential manner from a toe of the well towards a heel of the well; and sequentially fracturing at least a portion of the formation surrounding each selected zone.

The method of the invention has the advantage that it allows fracturing of a formation surrounding a wellbore to occur in any sequence, e.g. zones created can be fractured in any order. This allows fracturing of the well to occur sequentially from the heel to the toe of the well or from the toe to the heel of the well. Alternatively, fracturing of the zones can occur out of sequence and in any order.

The method of the invention allows the fracturing operation to be performed remotely. Thus all tools can be actuated and controlled from surface with no mechanical intervention required. "Remotely" in the context of the invention can mean controlling operations from the surface of the well without direct mechanical intervention downhole.

Remote downhole actuation can be achieved by any method selected from the group including communicating actuation commands to the downhole tool using: pressure modulations (detector in tool), nuclear source (detector in tool), chemical source (tracer in tool), radio source (reader in tool), acoustic source (hydrophone in tool), and magnetic source (reader in tool).

These examples of methods, by which the tools making up the tubular can be remotely actuated, require some detector within the downhole tool. The detector (or equivalent) within the tool can be electrically connected to a circuit capable of recognising the unique signal, processing that information and an actuation command and initiating actuation of the tool. One example of such a detector and electronic circuit embedded within a downhole tool is disclosed in published patent GB 2 434 820 B.

The method can include remotely actuating the selective flow path by communicating an actuation command downhole using at least one of the following remote actuation means selected from the group consisting of: radio frequency source; pressure sequencing; and timed actuation.

The selective fluid flow path between the interior and the exterior of the tubular can be provided by a downhole tool such as a sleeve valve that is movable to selectively open and close ports extending through a sidewall of the tubular to selectively create and obturate a flow path respectively.

The method can include remotely isolating the throughbore of the tubular by communicating an actuation command to the throughbore isolation means using at least one of the following remote actuation means selected from the group consisting of: radio frequency source, pressure sequencing and timed actuation.

The throughbore isolation means can be an isolation valve that selectively seals the throughbore. The throughbore isolation valve can be a flapper valve pivotable between a stowed position in which the throughbore is unobstructed and a deployed position in which the flapper substantially obturates the throughbore.

The method can include remotely actuating tools downhole by circulating objects downhole said objects being communicable with the tools when the tubular represents an open system such that fluids are flowable within the throughbore.

The tubular represents an open system when the tubular has at least one opening such that fluids sent downhole flow within the throughbore.

Objects that may be circulated downhole, said objects being communicable with the tools include: nuclear source, chemical source, radio source or magnetic source. Objects can be communicated downhole by gravity, pumping, adding them to fluid flow or any combination thereof.

One object circulated downhole can be a radio frequency identification tag. The downhole tools can be provided with readers (such as an antenna) coupled to an electronic circuit within the tool for detecting the presence of a radio frequency identification tag. Such a system is described in patent GB 2 434 820 B.

The method can include remotely determining actuation from surface by actuating the tools downhole using signals from surface or providing tools with pre-programmed timers to actuate the tools when the tubular represents a closed system.

The tubular represents a closed system when there are no openings within the tubular, such that fluids cannot flow freely within the tubular but instead back up within the throughbore.

The signals from surface for remote actuation of the tools can include pressure or acoustic signals. The signals from surface can include pressure sequencing.

Remote actuation by pressure sequencing can include modulated pressure sequencing. A distinctive profile of pressure modulations can be created at surface by modifying the pressure in the tubing. Transducers embedded within downhole tools can be pre-programmed such that the downhole tool is actuable in response to a distinctive pressure modulation profile.

The method can be a method of fracturing and producing hydrocarbons from a formation surrounding a wellbore including the steps of producing from the selected zones following the fracturing steps.

Hydrocarbons can be produced through the selective flow path. Alternatively, each portion of tubular can include a production flow path between the interior and the exterior of the tubular. The production flow path can be selectively actuable by movement of a sleeve valve to selectively cover ports extending through the sidewall of the tubing. The production ports can be provided with a mesh to restrict entry of particles above a predetermined size. The mesh can be a sand screen.

The method can include reselling to a primary configuration at the end of each fracturing operation, in which primary configuration the selective flow path(s) are closed and the throughbore isolation means are open such that the throughbore is unobturated.

The apparatus can be run into the wellbore in the primary configuration.

The method can include the step of automatically returning to the primary configuration after a predetermined period of time.

Downhole tools can be pre-programmed to a default configuration. The default configuration can be the primary configuration. All downhole tools can return to the default configuration after a certain or predetermined period of time, e.g. 6 hours, 12 hours, 24 hours or 48 hours. At least some downhole tools can be provided with a timer connected to the electronic circuit to return the downhole tool to the default configuration.

The method can include remotely actuating the tools to adopt a default configuration.

The method can also include providing all tools with a timer pre-programmed to remotely actuate the tools in their default configurations.

In the default configuration the throughbore isolation means can be open and the fluid flow paths can be closed.

Step (vii) can include pumping fracturing fluid through the tubular and directing fracturing fluid through the fluid flow path to fracture at least part of the surrounding formation. Step (vii) can include diverting fluid through the fluid flow path using the throughbore isolation means as a diverter.

Step (vii) can include fracturing at least part of the formation surrounding the well by pumping a fracturing fluid into the formation. The method can include different fracturing methods such as hydraulic fracturing or acid fracturing.

Step (vii) can include pumping fracturing fluid having particles suspended therein into the formation.

Suitable fluids having particulates suspended therein can be referred to as proppant fracturing fluids. Step (vii) can include pumping proppant fracturing fluid into the formation so that the method of the invention is a method of proppant fracturing a formation. The proppant fracturing fluid can include a mixture or gel of water, proppant and thickening agent in concentrations adjusted for the specific application. The proppant can include sand or ceramic beads. The thickening medium can include xanthum gel.

The method can include pumping fracturing fluid having particles suspended therein until the fractured part of the formation is full of particles and pumped fracturing fluid backs up within the throughbore of the tubular.

The method can include clearing particles within the throughbore by opening another selective flow path in a different zone, and pumping fluids within the throughbore, which fluids urge the particles into a different zone.

At least one clean-up (non-production) zone with an associated selective flow path and isolation means can be created for accepting particles to be cleared. A clean-up zone can be created at the end of the well closest to the toe.

This method maximises proppant packing in a zone by fracturing the formation until the fractured formation is full of proppant (a situation know as 'sand out').

Annulus isolation means can typically be provided on either side of the selective flow path in each portion of tubular. Isolating the annulus can be achieved by actuating annulus isolation means. The annulus isolation means can be a packer.

The method can include remotely actuating an annulus isolation means to isolate the annulus.

The method can include actuating the annulus isolation means by communicating actuation commands to the tool using a method selected from the group consisting of: radio frequency source; flow activation; timed activation; chemical actuation; and pressure signature actuation.

As an alternative, the annular isolation means can be mechanically actuated.

The method steps (i)-(ix) can be chronological. However, it will be appreciated that the method steps may not be necessarily chronological. For example, isolating the annulus to create zones can be achieved by flow actuable packers that are arranged to actuate by flowing fracturing fluid over the packer; thus step (iii) may occur simultaneously with step (vii).

The method can include anchoring the tubular in the wellbore prior to commencement of the fracturing operation. The method can include anchoring the tubular in the wellbore between method steps (ii) and (iii). The method can include anchoring the tubular in the wellbore towards an upper end of the tubular. The method can include anchoring the tubular in the wellbore in at least one other location along the length of the tubular. The method can include anchoring the tubular in the wellbore towards a toe end of the well.

BRIEF DESCRIPTION OF DRAWINGS

Embodiments of the present invention will now be described, by way of example only, and with reference to the accompanying drawings, which are.

DETAILED DESCRIPTION OF DRAWINGS

All the described embodiments utilise a tool string 20 illustrated schematically in FIGS. 1*a* to *j*. Three methods involving different fracturing sequences will be described:

sequential fracturing from a heel 87 to a toe 88 of the well;

out of sequence fracturing; and sequential fracturing from the toe 88 to the heel 87 of the well.

Each tool within the tool string 20 is configured and pre-programmed for remote actuation from surface according to the anticipated zone fracturing sequence.

Alternatively, each tool can be pre-programmed to respond to unique instructions, which enable any method of selective zone fracturing.

Figure 1A:
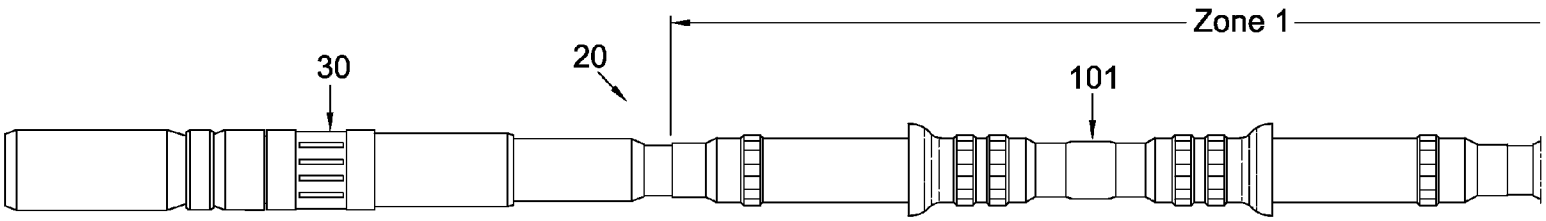
FIGS. 1*a* to 1*j* successive schematic side views of a tool string utilised in accordance with the method and system of the present invention.
Figure 1B:
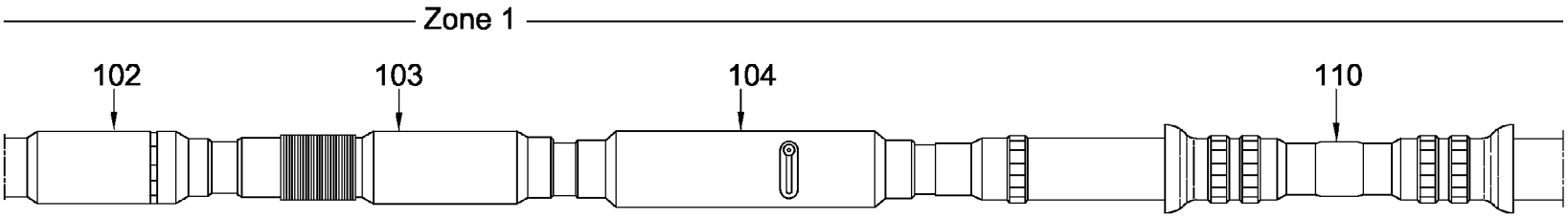
Figure 1C:
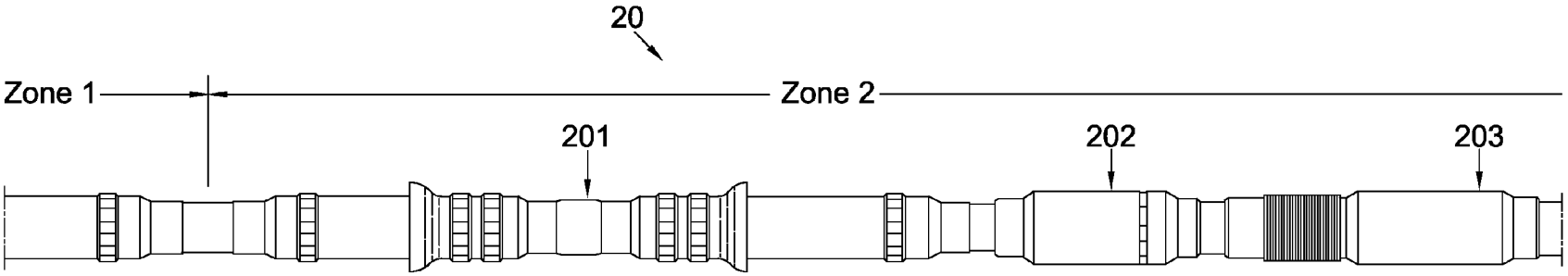
Figure 1D:
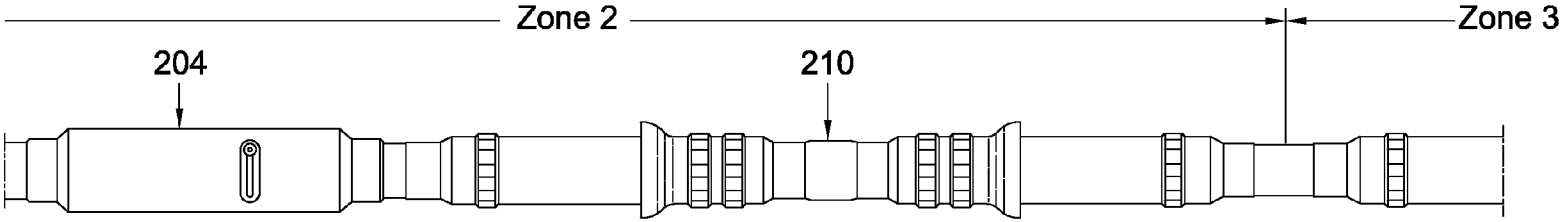
Figure 1E:
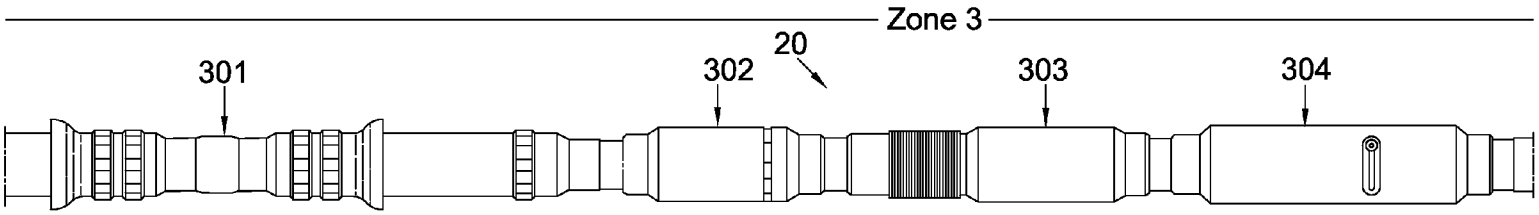
Figure 1F:
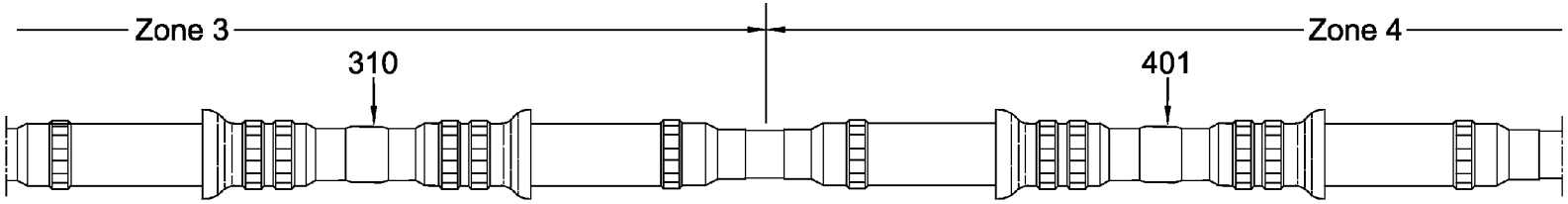
Figure 1G:
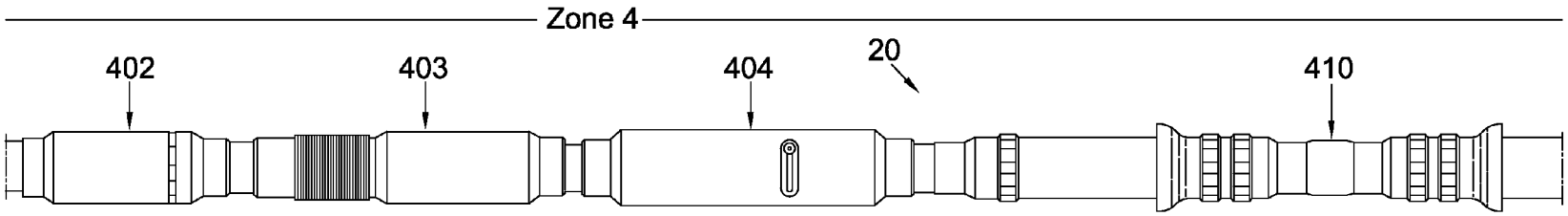
Figure 1H:
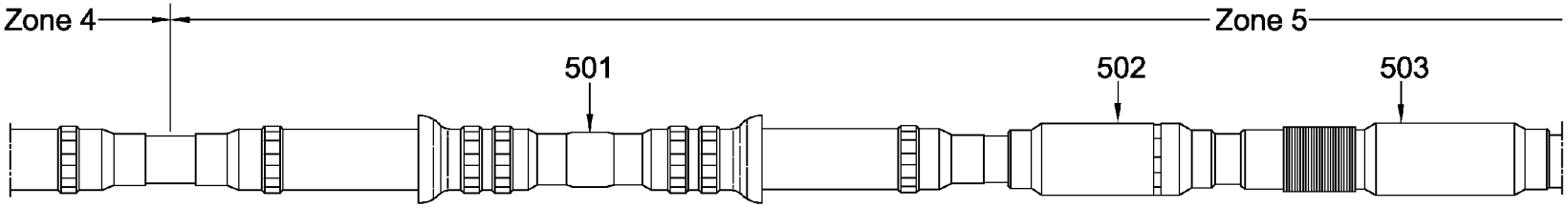
Figure 1I:
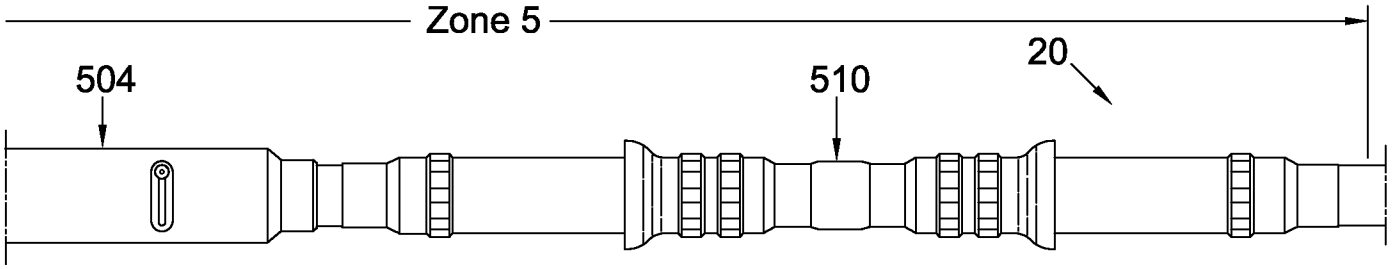
Figure 2:
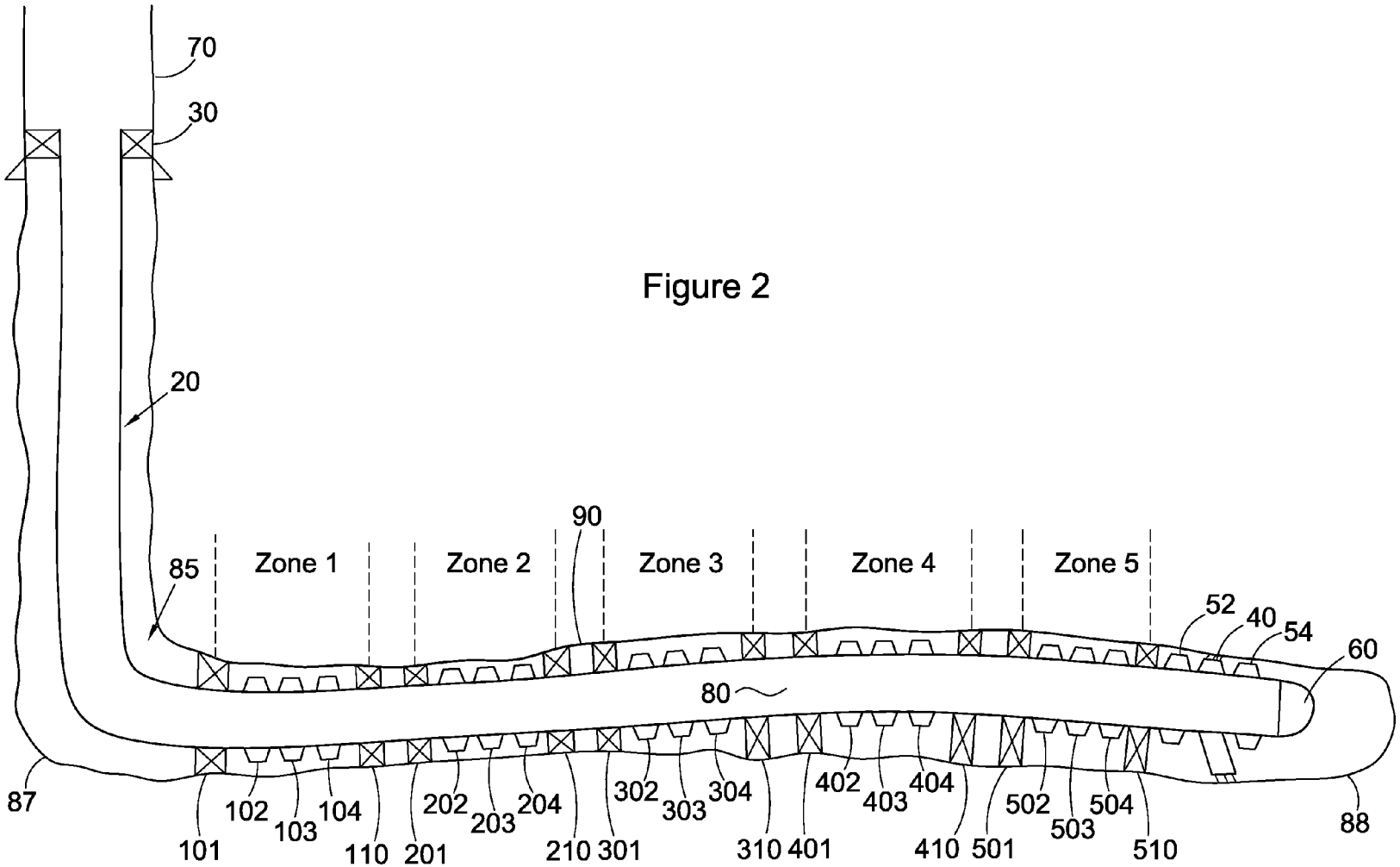
FIG. 2 a schematic view of the tool string of FIGS. 1*a* to 1*j* located within a wellbore.

An uphole (uppermost in use) end of the tool string 20 shown in FIG. 1*a* incorporates an upper anchoring tool in the form of a liner hanger packer 30. The liner hanger packer 30 is actuable to hang the tool string 20 from a liner hanger 70 (FIG. 2) within the wellbore.

Figure 1J:
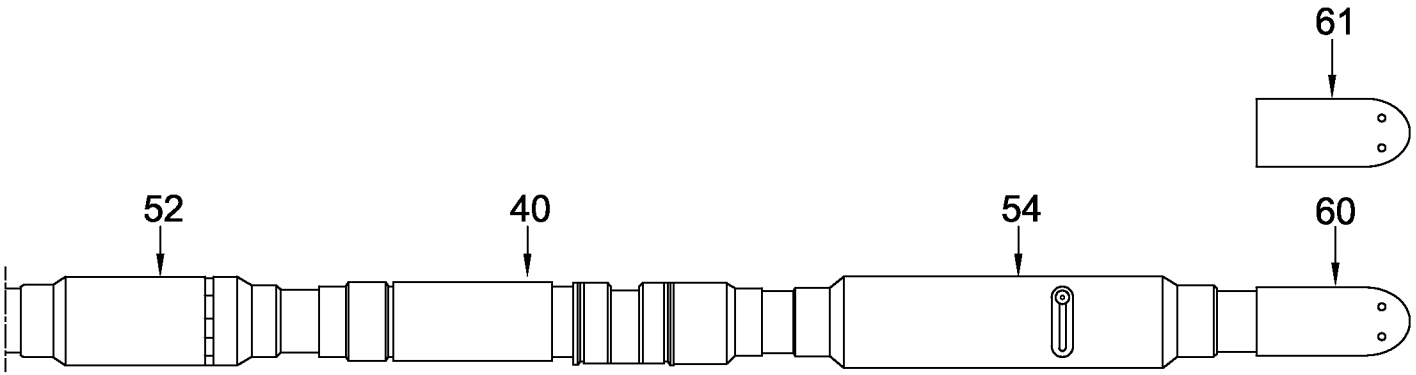

At its leading end, shown in FIG. 1*j*, the tool string 20 has a guide shoe 60 that is located closest to the toe 88 of the well in use. Adjacent the guide shoe 60 is a throughbore isolation means in the form of a lowermost flapper valve 54; a lower anchoring tool 40 in the form of a RokAnkor™ (Petrowell product reference: RokAnkor™ Slip System 54-RK-A0); and a selective flow path controlled by a fracture sleeve 52 movable to selectively uncover ports extending through the sidewall of the tool string 20.

Between the anchoring tools at either end, the tool string 20 is divided into several portions 1 to 5 corresponding to the areas or zones of the formation that are required to be fractured. The tool string 20 for each zone is made up from a fracture sleeve 102, 202, 302, 402, 502, a flapper valve 104, 204, 304, 404, 504 immediately downhole of the fracture sleeve 102, 202, 302, 402, 502, a production tool 103, 203, 303, 403, 503, and a packer 101, 110, 201, 210, 301, 310, 401, 410, 501, 510 at each end of the zone.

Each fracture sleeve 102, 202, 302, 402, 502 comprises ports (not shown) that are selectively uncovered to provide a fluid flow path between the interior of the fracture sleeve 102, 202, 302, 402, 502 and the exterior of the tool string 20. A suitable fracture sleeve 102, 202, 302, 402, 502 has Petrowell product reference RFID Operated Frac Sleeve 63-RF-50. The fluid flow path created by the open fracture ports allows fracturing fluid to be pumped into the surrounding formation. Each fracture sleeve 102, 202, 302, 402, 502 contains an electronics pack, a pressure transducer, an antenna for reading radio frequency identification (RFID) tags, a timer and a motor for driving the sleeve. The internal electronics are pre-programmed to enable each fracture sleeve 102, 202, 302, 402, 502 to be controlled by a uniquely programmed RFID tag, modulated pressure sequences and/or a timer to instruct selective opening and closing of the ports.

The timer within each fracture sleeve 102, 202, 302, 402, 502 can be pre-programmed to reset the fracture sleeve 102, 202, 302, 402, 502 in a default configuration so that after a predetermined period of time e.g. 48 hours, in the absence of other instructions, the ports are covered to close the fluid flow path to the exterior of the tool string 20.

The production tool 103, 203, 303, 403, 503 is in the form of an inflow control device (ICD). The ICD comprises a sleeve slidable to selectively cover ports (not shown). The sleeve is movable between a closed position where the ports are blocked and an open position to uncover the production ports and enable production of well fluids therethrough. Ports allowing fluid communication between the interior of the production tool 103, 203, 303, 403, 503 and the annulus are covered by a sand screen to restrict the size of particulate matter that can be produced through the production ports.

Internally, each production tool 103, 203, 303, 403, 503 is provided with an electronics pack, a pressure transducer, an antenna for reading radio frequency identification (RFID) tags, a timer and a motor for moving the sleeve to selectively uncover the ports. Actuation of each production tool 103, 203, 303, 403, 503 is controllable by modulated pressure sequences, RFID tags and/or an internal timer. Each individual production tool 103, 203, 303, 403, 503 is designed or programmed to improve the drainage profile across horizontal portions of the well to reduce water coning and maximise hydrocarbon recovery.

The tubing isolation valve is provided in the form of a flapper valve 104, 204, 304, 404, 504 or reservoir isolation valve (RIV). A suitable valve is manufactured by Petrowell under product reference: Reservoir Isolation Valve 63 RIV0. Each flapper valve 104, 204, 304, 404, 504 contains a flapper that is pivotable between a stowed position in which the throughbore is open and unobturated and a deployed position in which the flapper extends across the throughbore of the tubing to contact a sealing seat. Once sealed in the deployed position, the flapper is able to withstand high pressures expected within the throughbore 80 of the tool string 20.

Internally, each flapper valve 104, 204, 304, 404, 504 is provided with several components sealed within the housing: an electronics pack; a pressure transducer; an antenna for reading radio frequency identification (RFID) tags; a timer; and a motor for selective pivoting of the flapper within the throughbore 80. When in the deployed position, the flapper valve 104, 204, 304, 404, 504 substantially obturates the throughbore to hold pressure and also to act as a diverter to divert fracturing fluid out through the adjacent fracture sleeve ports. The flapper valve 104, 204, 304, 404, 504 is controllable by RFID tags, modulated pressure sequences and/or the internal timer.

The timer within each flapper valve 104, 204, 304, 404, 504 can be pre-programmed to reset the flapper valve 104, 204, 304, 404, 504 in a default configuration so that after a predetermined period of time e.g. 24 hours, in the absence of other instructions, the flapper opens the throughbore 80 of the tool string 20.

Annulus isolation means are provided in the form of packers 101, 110, 201, 210, 301, 310, 401, 410, 501, 510. The packers delimit each zone and ensure zonal isolation by substantially sealing an annulus 85 between the exterior of the tool string 20 and the open hole 87. An open hole packer used in the present embodiment has Petrowell product reference: CSI Open Hole Permanent Packer 52-CS10. Each packer 101, 201, 210, 301, 310, 401, 410, 501,510 is actuable in response to a unique pressure modulated sequence P2 and once actuated provides annular isolation between reservoir zones.

Before use, the electronics within the downhole tools are pre-programmed as required and the tool string 20 is made up as previously described. The tool string 20 has a run-in configuration in which all ports in the production tools 103, 203, 303, 403, 503 and fracture sleeves 102, 202, 302, 402, 502 are closed so that each sleeve is positioned to obturate the associated ports extending through the sidewall of the tool string 20. All the flapper valves 104, 204, 304, 404, 504 are open so that the throughbore of the tubing string 20 is unobstructed. The leading end of the tool string 20 can be open to allow fluid circulation during run-in if desired. Such a system allows full circulation and well control capabilities through the guide shoe 60. The tool string 20 is then run into the open hole 90. Since all ports are closed during run in a downhole motor or reamer shoe can be added at the end of the tool string 20 if desired.

According to the present embodiment the open hole 90 deviates at the heel 87. When the tool string 20 has reached the desired location and each portion of the tool string 20 is aligned adjacent the formation to be fractured, an RFID tag, Tag 1 (not shown) is circulated downhole. Tag 1 is pre-programmed to communicate with the flapper valve 54 closest to the toe 88 of the well. Tag 1 is pumped downhole with fluid and on reaching the flapper valve 54, Tag 1 passes within the throughbore 80 of the tool and the antenna within the flapper valve 54 reads the instructions from Tag 1. The instructions are processed by the electronics pack and a motor drives the flapper from the stowed to the deployed configuration. Thus the flapper valve 54 is actuated to close off the throughbore 80 and the tool string 20 now represents a closed system that can be pressured up as required.

Once the flapper valve 54 has been closed, the tool string 20 must be anchored in the wellbore. This is achieved by pressuring up the throughbore 80, which is now a closed system following the closing of the flapper valve 54 with Tag 1. The RokAnkor™ 40 and the liner hanger 30 are actuable in response to a threshold pressure. (Alternatively, the RokAnkor™ 40 and the liner hanger 30 can be actuated in response to a unique pressure pulse signature P1.) At surface an operator pressures up the throughbore 80 to the required threshold setting pressure and sets the liner hanger 30 and RokAnkor™ 40 to anchor the tool string 20 to the liner 70 and in the open hole 90 towards the toe 88 of the well respectively. This allows the tool string 20 to be set in the correct position relative to the zones of interest. The liner hanger 30 and RokAnkor™ 40 both function to anchor the tool string 20 in the open hole 90 to restrict excess lateral movement of the tool string 20 and improve the effectiveness of the packers.

Simultaneously or as a separate operation, the packers 101, 110, 201, 210, 301, 310, 401, 410, 501, 510 are actuated also using a threshold setting pressure (or alternatively, a pressure pulse actuation sequence P2). This packer 101, 110, 201, 210, 301, 310, 401, 410, 501, 510 setting operation creates and isolates individual zones 1 to 5 in preparation for the zone-by-zone fracturing operation.

Each of the three described embodiments below use the apparatus of FIGS. 1*a* to 1*j* made up in a tool string 20 described above and shown in the well in FIG. 2. Although the apparatus describes five production zones any of the following embodiments may include unlimited production zones.

1. Heel to Toe Fracture

For the sequential heel to toe method of fracturing a formation, zone 1 is the first zone of interest to be fractured. In order to fracture zone 1, the ports in the fracture sleeve 102 need to be opened.

All fracture sleeves 102, 202, 302, 402, 502, 52 are pre-programmed to open in response to a unique modulated pressure sequence, P3. A timer in each fracture sleeve 102, 202, 302, 402, 502, 52 actuates the fracture sleeve after a predetermined period of time, e.g. one hour following receipt of the signal. A transducer within the tool detects the pressure modulations and on receipt of the unique signal, P3, the electronics pack instructs the motor within each tool to axially translate the sleeve. All flapper valves 104, 204, 304, 404, 504, 54 are pre-programmed to move the flapper from the stowed to the deployed position in response to the same pressure sequence P3. A timer in each flapper valves 104, 204, 304, 404, 504, 54 actuates movement of the flapper after a predetermined period of time e.g. one hour following receipt of the signal.

The operator at surface controls the pressure within the tubing string in line with modulated pressure sequence P3 to instruct the opening of the ports of all fracture sleeves 102, 202, 302, 402, 502, 52 and simultaneously instruct all flapper valves 104,204,304,404, 504, 54 to isolate the throughbore of the tubing string 20. Thus in the region of zone 1, the fracture ports are open and the throughbore is blocked immediately downhole of the fracture ports.

Fracturing fluid is pumped downhole through liner hanger running tools and is directed out by the deployed flapper 104 through the open ports of the fracture sleeve 102 to fracture the formation surrounding zone 1. Proppant fracturing fluid (with suspended sand) is used for the fracture of the present embodiment. The pressurised fluid cracks the formation surrounding zone 1 and the sand is simultaneously packed within the cracks to prevent closure of the cracks. Fracturing fluid is pumped downhole until a pressure spike at surface indicates that the zone is full of sand (or after a predetermined proppant volume has been pumped downhole). At this point, the fracturing operation of zone 1 is complete.

With the ports of the fracture sleeve 102 open, the tool string 20 is an open system and objects can be circulated within the first portion of the throughbore 80. Once the operator recognises that the formation of zone 1 is packed with sand, an electronic tag T2 is pumped downhole. T2 is pre-programmed to communicate with and instruct the fracture sleeve 102 to close the ports extending through the sidewall of the tubing string 20. This closes the circulation path to zone 1 by closing the ports of the fracture sleeve 102. Closure of the ports by the fracture sleeve 102 results in the tool string 20 once again reverting to a closed system that can be pressured as required. If excess sand has backed up within the interior of the tubing to substantially block the tubing 20 (a situation known as 'sand-out') such that the tag, T2 cannot reach the fracture sleeve, a unique modulated pressure sequence can be controlled at surface to instruct closure of the fracture sleeve 102.

An operator at surface then generates a unique pressure modulation sequence P4 within the tool string 20 and the flapper 104 is pre-programmed to return to its stowed position and open in response to the pressure sequence P4.

Zone 1 has now been successfully fractured, the ports of the zone 1 fracture sleeve 102 are closed and the zone 1 flapper 104 is open. Zone 2 is the next zone of interest in a sequential heel 87 to toe 88 fracture. The same operation is now repeated for zone 2.

The zone 2 fracture sleeve 202 is already open and the zone 2 flapper 204 is already closed in preparation for the fracturing of zone 2. Fracturing fluid is pumped downhole to fracture the formation surrounding zone 2. Any excess sand within the throughbore 80 following 'sand-out' of zone 1 is forced into the formation of zone 2. Thus, the throughbore 80 around zone 1 is cleared by forcing sand into the formation at zone 2.

Once the fracturing of zone 2 is complete (for example when a calculated proppant volume has been pumped downhole or if sand-out occurs), an electronic tag, T3 is circulated downhole. T3 is pre-programmed to instruct closure of the ports and flow path of the fracture sleeve 202. The tool string once again represents a closed system. Another unique pressure sequence, P5 initiated within the tubing gives a unique instruction to open the flapper 204 and unblock the throughbore 80. Zone 2 has then been fractured successfully.

The same sequence can be repeated for all subsequent zones 3 to 5 sequentially from the heel to the toe of the well. Following fracturing of each zone a tag is circulated to close the fracture ports and another pressure sequence P(x+1) is used to open the flapper valve. This method can be used as many times as required and there is no limit to the number of zones that can be fractured in a well arranged to operate in this way. The fact that no bore restrictions are present means that any number of tools can be arranged in series to allow formation fracturing by the method of the invention.

Once the final zone has been fractured, (zone 5 according to the present embodiment) the zone 5 fracture sleeve 502 is instructed to close the ports and the flapper 504 is moved into the stowed position so that the throughbore of the tubing 20 has no obstructions. The final fracture sleeve 52 of the tool string 20 by the pressure sequence P3. Fluid is pumped downhole through the tubing string to entrain excess sand that has accumulated within the throughbore 80 of the tubing 20. Excess sand is pushed into the formation surrounding fracture sleeve 52. This sacrificial zone is used to clean the tubing string 20 of sand in preparation for the production of formation fluids through the production ports of the production tools 103, 203, 303, 403, 503. Thus, the sand is cleared from the throughbore without any separate remedial action. A further tag, T7 is dropped to instruct closure of the ports of the fracture sleeve 52.

Once the sand has been flushed out of the throughbore 80 of the tool string 20, the fracturing operation and subsequent clean up is complete and the upper completion can be installed in the well.

Ports of the production tool are now required to be opened in preparation for the production of hydrocarbons therethrough.

The production tools 103, 203, 303, 403, 503 can be pre-programmed to respond to the pressure sequence, P9 to actuate the tool and cause opening of the production ports. Production of hydrocarbons is thus initiated. Ports of the production tools are surrounded by a sand screen mesh to restrict ingress of sand and larger particles with the hydrocarbons. The well can be produced one zone at a time, with the closure and opening of production ports achieved by predetermined time delays from receipt of the pressure sequence P14.

The method of the present invention maximises efficiency by allowing for 'sand-out' so that an operator knows with certainty that a particular zone is packed to capacity with sand.

One advantage of the method is that fracture sand from 'sand-out' of a higher zone is simply pumped into the subsequent fracture zone, meaning that no separate operation need be performed to clear the sand from within the tubing 20. Thus, the above embodiments remove the requirement for any clean up. Further sacrificial zones can be spaced along the well if required where multiple zones are being successively fractured. These zones can capture accumulated sand so that no separate cleanup operation is necessary.

2. Toe to Heel Fracturing

According to a second embodiment of the present invention, the method enables the well to be produced sequentially from the toe 88 to the heel 87 of the well. The fracturing operation is controlled in the reverse direction with remote actuations controlled by pressure sequence when the tool string 20 represents a closed system and a tag where the tool string 20 represents an open system.

For the sequential toe to heel method of fracturing a formation, zone 5 is the first zone of interest to be fractured. In order to fracture zone 5, the ports in the fracture sleeve 502 need to be opened. The fracture sleeve 502 is pre-programmed to open in response to a unique pressure sequence, P3. The flapper valve 504 is pre-programmed to close in response to the same pressure sequence, P3. The operator at surface controls the pressure within the tubing string in line with pressure sequence P3 to open the ports of the fracture sleeve 502 and simultaneously close the flapper 504 to isolate the throughbore of the tubing string 20 in the region of zone 5.

Proppant fracturing fluid is pumped downhole through liner hanger running tools and is directed out by the closed flapper 504 through the open ports of the fracture sleeve 502 to fracture the formation surrounding zone 5. A calculated volume of fracturing fluid is pumped downhole. At this point, the fracturing operation of zone 5 is complete.

With the ports of the fracture sleeve 502 open, the tool string 20 represents an open system and objects can be circulated within the throughbore 80. An electronic tag T2 is pumped downhole. T2 is pre-programmed to move the fracture sleeve 502 to close the ports extending through the sidewall of the tubing string 20. This closes the circulation path to zone 5 by closing the ports of the fracture sleeve 502. Closure of the ports by the fracture sleeve 502 results in the tool string 20 once again reverting to a closed system that can be pressured as required. If excess sand blocks the throughbore such that the tag, T2 cannot be circulated downhole, a timer can respond to close the ports of the fracture sleeve after a predetermined period of time e.g. 48 hours.

Zone 5 has now been successfully fractured and an operator at surface generates a unique pressure sequence P4 within the tool string 20 and the flapper 504 is pre-programmed to open in response to the pressure sequence P4. Zone 4 is the next zone of interest in a sequential toe 88 to heel 87 fracture. The same operation is now repeated for zone 4.

The next fracture sleeve 402 is responsive to the same pressure sequence, P4 and is pre-programmed to move to uncover the fracture ports. Flapper 404 is pre-programmed to close in response to the same pressure sequence, P4 after a short time delay. The zone 4 fracturing operation begins. Once the operator has remotely actuated the opening of fracture ports and closing of the throughbore in zone 4 by initiating the pressure sequence P4. Fracturing fluid is pumped downhole to fracture the formation surrounding zone 4. Once the fracturing of zone 4 is complete, an electronic tag, T3 is circulated downhole. T3 is pre-programmed to cause closure of the ports and flow path of the fracture sleeve 402. Another unique pressure sequence, P5 initiated within the tubing gives a unique instruction to open the flapper 404 and unblock the throughbore 80 and simultaneously open ports of the fracture sleeve 302 and close the zone 3 flapper 304 following a short time delay.

The same sequence can be repeated for all subsequent zones 3 to 1 sequentially from the toe 88 to the heel 87 of the well. For example pressure sequence P (X+1) is used to open the flapper from a previous fracture zone, open the fracture ports of the next zone to be fractured and close the flapper valve. Following fracturing of that zone a tag is circulated to close the fracture ports. This method can be used as many times as required and there is no limit to the number of zones that can be fractured in a well arranged to operate in this way. The fact that no bore restrictions are present means that any number of tools can be arranged in series to allow formation fracturing by the toe to heel method of the invention.

Once the final zone has been fractured, (zone 1 according to the present embodiment) the zone 1 fracture sleeve 102 closes the ports and the flapper 104 is opened so that the throughbore of the tubing 20 has no obstructions.

The final fracture sleeve 52 at the toe end 88 of the tool string 20 is pre-programmed to respond to a unique pressure sequence, P9 to move the fracture sleeve 52 and open the ports to the surrounding formation. Fluid can then be pumped downhole and excess sand that has accumulated within the throughbore 80 of the tubing 20 is pushed into the formation surrounding fracture sleeve 52. This cleans the tubing string 20 of sand in preparation for the production of formation fluids through the production ports. Thus, the next step in the operation clears up the sand without any separate remedial action.

Once the sand has been flushed out of the throughbore of the tool string 20 a tag, T7 is sent downhole to instruct closure of the fracture ports by the sleeve 52. The upper completion is then installed.

Ports of the production tools can be opened using a unique pressure sequence either individually or collectively with or without time delays.

3. Any Sequence Fracturing

The method of the invention also enables fracturing and production in any desirable sequence. One random out of order fracturing sequence will now be described as a second embodiment of the invention.

Run-in and set-up of the tool string 20 have been previously described with reference to the first embodiment of the invention. Again, the lowermost flapper valve 54 is closed and the RokAnkor™ 40, liner hangar 30 and packers 101, 110, 201, 210, 301, 310, 401,410, 501, 510 are set as described previously.

The zone selected to be fractured first, for example zone 3 is targeted by sending a unique pressure signal, Px, to open the zone 3 fracture ports by movement of the fracture sleeve 302 and close the zone 3 flapper valve 304 to divert flow of fracturing fluid out through the fracture ports into the formation surrounding zone 3. An electronic tag, Ty, having a unique identification is circulated through the fracture tool 302 and the fracture tool 302 is pre-programmed to read tag, Ty, and respond to its command to close the fracture ports. A unique pressure signal, P (x+1), opens the zone 3 flapper valve 304.

Any zone can be subsequently selected for the fracturing operation. When the system is closed, the fracture tools and flapper valve must be actuated using a unique predetermined pressure sequence. When circulation is possible within the tool string 20 (for example when the fracture ports are open) a suitably pre-programmed tag can be circulated downhole with a command for the appropriate tool. In this way any zone can be fractured in any chosen sequence.

The final step in the sequence is to clear excess sand from the throughbore 80 by moving the fracture sleeve 52 to open ports extending through the sidewall of the tubing string 20 using pressure sequence P13. Again, this enables excess sand to be pumped through the ports of the fracture sleeve 52 into the sacrificial zone surrounding the end of the tubing string 20.

As a default, all tools for any of the described fracture sequences, can be provided with a timer and in the event that signals are not received or transmitted. Each tool can be pre-programmed to perform a certain function after a predetermined length of time. For example, the lowermost flapper valve 54 is pre-programmed to close off the throughbore 80 twenty four hours after initial run-in, so that in the event that the tag(s) fail to deliver the close command, the end of the tool string 20 can be closed off to allow the pressure operations to proceed that lead to fracturing and production of the well. Other flapper valves 104, 204, 304, 404, 504 can be provided with a timer to ensure that the flapper remains in the stowed position and they do not present an obstruction in the throughbore in the event that an actuation signal is not received. Each fracture sleeve 102, 202, 302, 402, 502 can be provided with a default timer so that the sleeve closes after a predetermined period of time. This allows pressure operations to proceed in the event that an actuation command is not properly received.

The above described method and apparatus is preferable to conventional methods since the full bore diameter is available for the subsequent production of hydrocarbons once the well is brought on-stream and there are no obstructions to choke the flow within the inner diameter of the tubing string. Lack of restrictions in the bore place no limits on the length of the well and the multiple zones that could potentially be produced.

Another advantage of the present invention is that the method allows greater flexibility. For example once the apparatus has been run into the well an operator can vary the fracturing sequence since the apparatus is not necessarily limited to a particular configuration at set-up or as run into the well.

The ability of the system to be operated remotely and the default operations that can be pre-programmed allow a high level of control over the well for both the fracturing and subsequent production of hydrocarbons, when compared with existing systems.

Although the methods described above use five zones, it will be appreciated that the methods can be used to fracture and produce from wells having any number of zones and is especially advantageous for wells having multiple zones. Additionally, the tool string 20 can contain as much blank tubing as required to space the zones according to the formation of interest.

All described embodiments are particularly advantageous to proppant fracturing where proppant such as sand suspended in fluid is pumped into the formation, although the method applies equally to other methods of fracturing, such as hydraulic fracturing and acid fracturing. Where hydraulic or acid fracturing methods are performed, the inflow control device can be omitted and fluids can be produced through the fracturing ports.

Modifications and improvements can be made without departing from the scope of the invention. The tool string 20 can be made up using additional tools and blank lengths of pipe to give the functionality desired for a particular application and provide a tool string 20 having zones of a length best suited to the characteristics of the particular formation to be fractured. The tool string 20 can be provided with a power reamer 61 at its leading end substituted in place of the guide shoe 60.

Fracturing fluid can include sands or beads in suspension or any other suitable fluid for fracturing and packing out the fractured formation.

What is claimed is:

1. A method of fracturing a formation surrounding a wellbore comprising the steps of:

(i) providing a tubular including at least two portions, each portion comprising an annulus isolation means, a selective flow path between the interior and the exterior of the tubular, and a throughbore isolation means for selectively obturating a throughbore of the tubular;

(ii) running the tubular into the wellbore;

(iii) isolating an annulus between the exterior of the tubular and the wellbore to thereby create at least two isolated zones;

(iv) selecting any zone to be fractured;

(v) opening, such as remotely opening, the flow path in the portion of tubular corresponding to the selected zone so as to allow fluid to flow between the interior and the exterior of the tubular;

(vi) isolating, such as remotely isolating, the throughbore of the tubular so as to obturate the throughbore by closing the throughbore isolation means in the portion of tubular corresponding to the selected zone so as to prevent fluid from flowing along the throughbore; and (vii) fracturing at least part of the formation surrounding the well.

2. The method according to claim 1, further including the steps of:

(viii) closing, such as remotely closing, the flow path in the portion of tubular corresponding to the selected zone so as to prevent fluid from flowing between the interior and the exterior of the tubular; and (ix) opening the throughbore of the tubular by opening, such as remotely opening, the throughbore isolation means in the portion of tubular corresponding to the selected zone so as to allow fluid to flow along the throughbore of the tubular.

3. The method according to claim 2, including repeating at least steps (iv) to (vi) to thereby fracture at least part of the formation surrounding a different zone of the well.

4. The method according to claim 1, wherein step (iv) includes the step of selecting an uphole zone to be fractured before a downhole zone to be fractured.

5. The method according to claim 1 including the steps of:

providing a tubular including a plurality of portions;

creating a plurality of zones;

selecting one zone at a time in any order; and successively fracturing at least a portion of the formation surrounding each selected zone.

6. The method according to claim 1 including the steps of:

providing a tubular including a plurality of portions;

creating a plurality of zones;

selecting one zone at a time in a sequential manner; and sequentially fracturing at least a part of the formation surrounding each selected zone.

7. The method according to claim 6 including:

selecting one zone at a time in a sequential manner from a heel of the well towards a toe of the well; and sequentially fracturing at least a part of the formation surrounding each selected zone.

8. The method according to claim 6 including:

selecting one zone at a time in a sequential manner from a toe of the well towards a heel of the well; and sequentially fracturing at least a portion of the formation surrounding each selected zone.

9. The method according to claim 1, including remotely actuating the selective flow path between the interior and the exterior of the tubular by communicating an actuation command to a downhole tool using at least one of the following remote actuation means selected from the group consisting of: radio frequency source; pressure sequencing; and timed actuation.

10. The method according to claim 1, including remotely isolating the throughbore of the tubular so as to prevent fluid from flowing along the throughbore of the tubular by communicating an actuation command to the throughbore isolation means using at least one of the following remote actuation means selected from the group consisting of: radio frequency source; pressure sequencing; and timed actuation.

11. The method according to claim 1, whereby remotely actuating tools downhole includes circulating objects downhole, said objects being communicable with the tools, when the tubular represents an open system with fluids flowable within at least a portion of the throughbore.

12. The method according to claim 1, whereby remotely actuating tools downhole includes determining actuation from surface to actuate the tools when the tubular represents a closed system.

13. The method according to claim 1, including resetting to a primary configuration at the end of each fracturing step, in which primary configuration each selective flow path between the interior and the exterior of the tubular is closed and the throughbore isolation means are open such that the throughbore is unobturated and fluid is allowed to flow along the throughbore of the tubular.

14. The method according to claim 13, including the step of automatically returning to the primary configuration after a predetermined period of time.

15. The method according to claim 1, wherein step (vii) includes pumping fracturing fluid having particles suspended therein into the formation.

16. The method according to claim 15, including pumping fracturing fluid having particles suspended therein until the fractured part of the formation is full of particles is and pumped fracturing fluid backs up within the throughbore of the tubular.

17. The method according to claim 15 or, when dependent on claim 2, including clearing particles within the throughbore of the tubular by opening another selective flow path in a different zone between the interior and the exterior of the tubular, and pumping fluid within the throughbore to clear the particles into a different zone.

18. The method according to claim 1, including remotely actuating an annulus isolation means to isolate the annulus.

19. The method according to claim 18, including actuating the annulus isolation means by communicating actuation commands to the annulus isolation means using a method selected from the group consisting of: radio frequency source; flow activation; timed activation; chemical actuation; and pressure signature actuation.

* * * * *